United States Patent [19]

Moore

[11] 4,158,275

[45] Jun. 19, 1979

[54] INSULATED WALL AND WALL PART

[76] Inventor: Alvin E. Moore, 8712 Manini Way, Bay St. Louis, Miss. 39520

[21] Appl. No.: 863,126

[22] Filed: Dec. 22, 1977

[51] Int. Cl.[2] ..... E04B 1/74; E04F 13/04; E04C 1/06

[52] U.S. Cl. ..... 52/210; 52/404; 52/454; 52/577; 52/DIG. 9

[58] Field of Search ..... 52/577, 576, DIG. 9, 52/382, 210, 404, 454

[56] References Cited

U.S. PATENT DOCUMENTS

| | | | |
|---|---|---|---|
| 946,773 | 1/1910 | Coleman | 52/382 |
| 984,541 | 2/1911 | Coleman | 52/382 |
| 3,857,215 | 12/1974 | Moore | 52/DIG. 9 |
| 3,858,376 | 1/1975 | Moore | 52/DIG. 9 |

*Primary Examiner*—John E. Murtagh
*Attorney, Agent, or Firm*—Alvin E. Moore

[57] ABSTRACT

An inexpensive, thoroughly insulated upright-wall, ceiling, floor or roof, made of panels fastened together along contacting panel edges. Each panel has a can-supporting, substantially planar element (a sheet of plywood, masonite, plastic, metal lath, or the like), reinforcing bars defining outer edges of the panel, layers of cans between the reinforcing bars, wire or plastic panel-reinforcing network on the cans; and optionally it may include molded matrix material (foamed, cellular, polyolefin plastic, or concrete of portland or other cement and sand or porous aggregate —for example, cinders, vermiculite, pumice, charred sawdust or the like) on the cans. The can-supporting element is placed in a mold or rack; a plurality of insulating layers of cans are put on this element, preferably with their axes parallel to it; reinforcing network is placed on the cans and fastened to the bars; and optionally moldable plastic material in fluent form may be poured or injected onto the network and cans. Each panel optionally includes attachment flanges that are integral with the reinforcing network and fastened to the panel-reinforcing bars. The wall preferably includes a wall plate (preferably of wooden material—for example a sawed-lumber plank or bar of masonite) fastened to tops of the panels, and has wall-finishing material which may include bricks, concrete blocks, or stucco, connected to surfaces of the panels by mortar or the like, or instead may include siding, nailed or otherwise fastened to the reinforcing bars.

21 Claims, 12 Drawing Figures

INSULATED WALL AND WALL PART

The present invention comprises an improvement of this inventor's prior invention in patent application Ser. No. 772,218, filed on Feb. 25, 1977 (U.S. Pat. No. 4,068,429 of Jan. 17, 1978).

In the current crisis concerning petroleum, electric power and other energy, excellent insulation of buildings and vehicles has become highly important. But there is a drastic shortage of conventional insulation, such as rockwool and fiberglass, due to present great demand for it; and this scarcity and the resulting high prices are handicaping efforts to conserve energy.

In view of these facts, some objects of the present invention are to provide: (1) a thoroughly insulated, inexpensive wall, utilizing a plurality of insulating layers of bright-surfaced, preferably used cans between the exterior and interior of the wall, these cans being between wall-reinforcing, can-supporting elements; (2) such a wall comprising panels that are fastened together at panel edges; (3) a wall as in (2) above, in which at least some of the panels have door or window frames; (4) a wall part including a plurality of layers of cans that are between exterior and interior can-supporting elements and between panel-reinforcing elements that are at opposite edges of the wall part; (5) a wall part as in (4) above, containing a wall-opening frame (for a window or door) that has sufficient width to support adjacent cans of each of the can layers; (6) a wall comprising a plurality of panels of the above type and exterior wall-finishing material which includes masonry units, siding, or troweled or sprayed stucco. These and other objects of the invention are indicated in the following specification and the attached drawings.

Figures 1, 2, 3, 4, 5, 6, 7, 8, 9, 10, 11, 12:
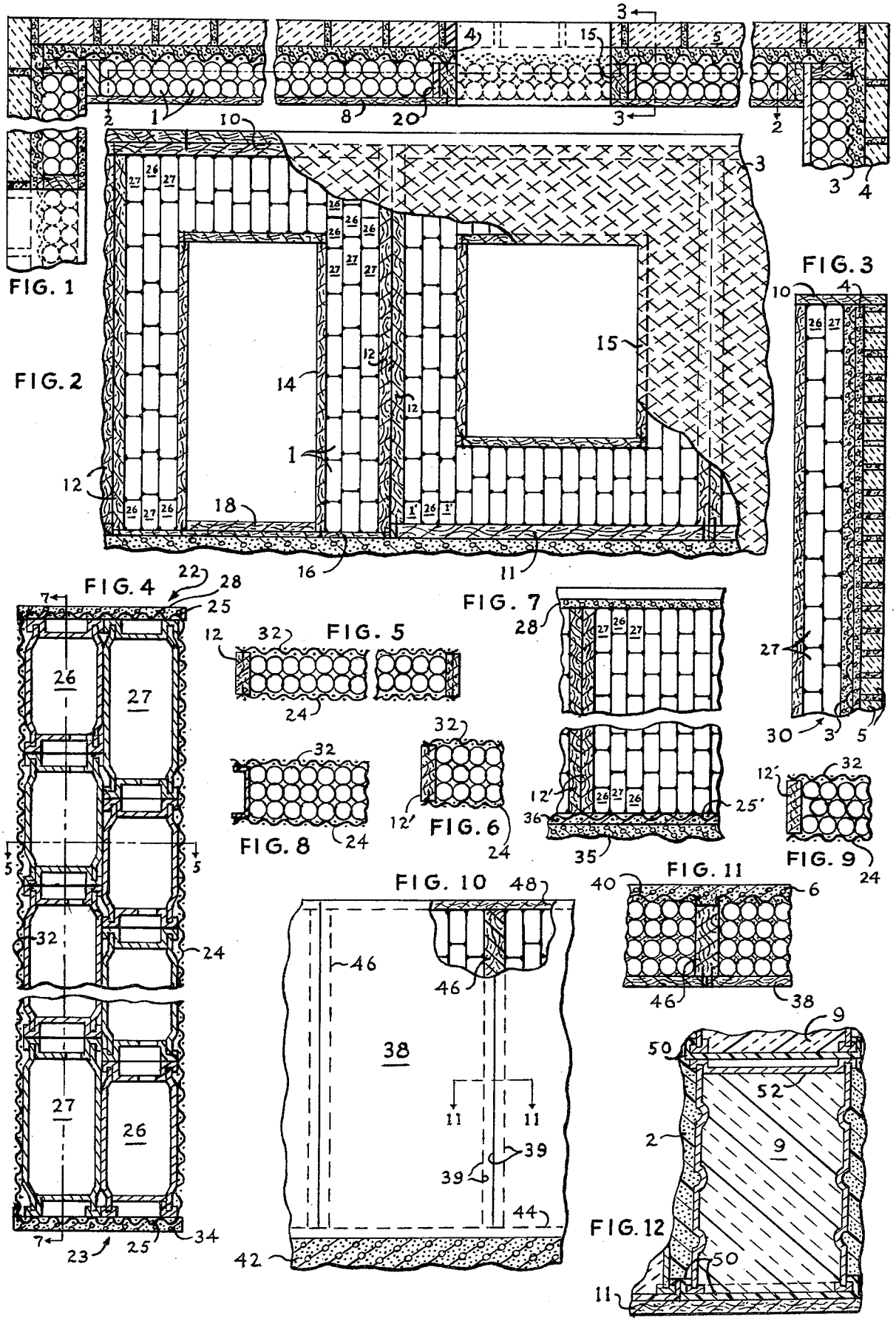
FIG. 1 is a top plan view of a wall, partly broken away and in section along a horizontal plane thru window and door frames.
FIG. 2 is a fragmentary elevational view, shown before application of the exterior masonry or stucco, partly in section from the plane 2—2 of FIG. 1.
FIG. 3 is a fragmental sectional view from the plane 3—3 of FIG. 1, but showing the wall as comprising two layers of the cans and as optionally not having the top wall plate of FIG. 2.
FIG. 4 is a sectional view of a form of the wall and wall part in which the insulating layers of cans are exteriorly, interiorly and at edges supported by reinforcing mesh.
FIG. 5 is a sectional view from a plane indicated by the line 5—5 of FIG. 4, partly broken away, illustrating the invention as having two insulating layers of cans, supported exteriorly and interiorly by reinforcing mesh and at edges by reinforcing bars, to which the mesh is attached.
FIG. 6 is a fragmental, sectional view similar to FIG. 5, but showing three insulating layers of cans.
FIG. 7 is a sectional view from a plane comparable to that indicated at 7—7 of FIG. 4, showing a modification of the invention form of FIG. 4.
FIG. 8 is a fragmentary sectional view, similar to FIG. 6, but indicating the side bars as comprising metal or plastic extrusions, to which panel-reinforcing network is fastened by welding, solder, rivets, screws or glue.
FIG. 9 is a fragmental view, similar to FIG. 6, but showing the rows of cans in adjacent can layers as being staggered.

FIG. 10 may be considered as an elevational view of panels of the invention joined in an upright wall or a plan view of the panels in a ceiling or floor, part of the figure being broken away to illustrate cans adjacent to and having axes parallel to a scantling or stud, to which the panels are attached;

FIG. 11 is a sectional detail view from a plane comparable to that indicated at 11—11 in FIG. 10, showing four insulating layers of cans; and FIG. 12 is a fragmentary view in section across a construction member utilizing cans of the currently common coffee-containing type, preferably containing thermal insulation.

The present invention is of a paneled can-comprising wall (an upright wall, ceiling or roof), usable in a building anchored to land, a mobile home or other trailer, a land vehicle, boat, or the like, and includes the panel that forms a part of the wall. Bright-surfaced cans (1, 26 and 27) are arranged in a plurality of thermally insulating can-layers between exterior and interior surfaces of the wall. The axes of the cans preferably are approximately parallel to these wall surfaces. In each of the illustrated construction panels, molded, insulating, can-stabilizing matrix material optionally may be located on a substantial portion of the can-layers. Such material (shown, for example, at 2 in FIG. 12) may be foamed polyolefin plastic (for example, polyurethane), or cement—for example, calcareous cement (portland cement or mortar cement of portland cement and lime), formica cement, epoxy, asphalt or other organic cement) mixed with fine aggregate (for example, cinders, sand, bits of expanded baked clay or shale ("Haydite"), vermiculite, pumice, shredded or ground polyolefin plastic, charred sawdust or ground bark). Although this material is an optional part of the invention, the present need for a very inexpensive but thoroughly insulated wall has influenced the inventor to currently eliminate most or all of the matrix material 2 from around the cans. The mortar or other adhesive material that is on the mesh 3 (for example, as material 4 that bonds the bricks or concrete blocks 5 to the can-comprising panels or as a first coat of stucco, indicated at 6 in FIG. 11) preferably contains fine, porous aggregate, such as cinders, bits of expanded baked clay or shale, vermiculite, pearlite or pumice, and thus also adds thermal insulation to the wall. During the optional wall construction that comprises nailing outer panels, clapboards, flooring or the like to upright studs or floor or ceiling joists insulating mortar of this type also may be placed between the outer boards and the can-comprising panels. When the construction comprises panels of cans between upright studs (as indicated in FIGS. 10 and 11), the insulating mortar or the like may be dropped between the can-comprising panels and the bricks or blocks 5 as they are laid (or between the can panels and clapboards or other siding which may be of masonite, aluminum or plastic), in successive amounts as the siding is nailed to the studs. When the outer wall-finishing material comprises wall-high panels of masonite, plywood or the like, nailed to the studs, either this insulating mortar is eliminated or it is troweled or sprayed as stucco on the outer mesh as indicated at 6 in FIG. 11, or on both the outer and inner surfaces of mesh of the type illustrated in FIG. 4, before fastening the final wall-finishing panels to the studs.

The cans 1 preferably are of thin metal, but optionally may be of dense strong plastic or of glass (jars or bottles); and the preferably planar element 8 that backs them may be a sheet of plywood, masonite, plastic, gypsum board, metal sheet, metal lath, or the like. The cans may contain porous thermal insulation (exampled at 9 in FIG. 12); but when, as is preferred, they are of the type which has contained beer or soft drinks such insulation preferably is not utilized. Air is an excellent insulating material when it is confined in small spaces, such as those provided by such cans of the liquid-containing type, which, being of small volume and having bright reflecting surfaces, provide excellent insulation. This invention comprises at least two layers of insulating cans between the wall's outer and inner surfaces; and the inventor's current preference is to have three or four insulating layers of the smaller cans of liquid-containing type. These may be sawed into shorter units (1'), if such be necessary to fit in a required location.

The currently preferred form of the invention is illustrated in FIGS. 1 to 3, 6 and 7, with some variation of the structure of FIGS. 1 to 3 being shown in FIGS. 6 and 7. As shown in FIGS. 1 and 2, each of the panels of the wall (or floor, ceiling or roof) comprises four panel-edge bars (for example, of sawed lumber, masonite scantlings, plastic bars, or aluminum-alloy extrusions—channels or the like that are apertured for reception of screws). These bars serve as can-supporting means, as wall-reinforcing means, means for attaching panels together in the wall, and as means for attachment of optional mesh. The bars 10 and 11 are at the top and bottom of the panel when it is in an upright wall or slanted roof, and the side bars 12 then are studs or rafters. The panels may be fastened together by toe-nailing contiguous bars of each adjacent pair of the panels—or by bridging across from one upper bar 10 to another bar 10 by nailing or screwing metal strips (for example, short lengths of pipe strap) on the bars—and/or by glueing together contacting faces of the bars 12. Preferably the cans are covered by a reinforcing network, 3, which may be wire mesh (for example, metal lath or poultry fencing) or of strong plastic. The network 3 as exampled in FIG. 2 preferably is poultry fencing; and when stucco 6 is used it easily penetrates the wide mesh of the network and into spaces between curved surfaces of the adjacent can layer, stabilizing the cans. And when an optional network flange (preferably integral with the sheet of network) is present at a side edge or edges of the panel it is fastened, with or without nails and pipe strap, by lapping each flange over the adjacent reinforcing bar of an adjoining panel and nailing or screwing or otherwise fastening the flange in place.

Each of the bars 10, 11 and 12 preferably has a width in the neighborhood of the wall-exterior-to-interior width of the plurality of layers of cans. Since cans of the preferred, smaller liquid-containing type are slightly over two and one-half inches in diameter, the bars 12' (FIG. 6) that are associated with three insulating layers of the cans preferably are standard "one-by-eight" (or "two-by-eight") pieces of lumber, which are approximately seven and three-fourths inches wide. And when there are four layers of cans of this type (as preferably are utilized in FIGS. 7 and 10) the bars are preferably "one-by-ten" (or "two-by-ten") standard pieces of lumber, which are approximately nine and three-fourths inches wide, and three of the rows of cans are staggered as in FIG. 9. In this four-can-layer panel form, with the cans arranged as illustrated in FIG. 11, the edges of the mesh 3 are slightly bent (indented) to reinforcing-bar edges during the course of fastening the mesh to the bars, because the four can layers arranged as in FIG. 11 have a total thickness a little over nine and three-fourths inches.

The substantially planar can-supporting element 8 is nailed or screwed to the bars 10, 11 and 12. Instead of the plywood or masonite sheet 8, this can-supporting element may be metal lath (or other strong mesh), as illustrated at 24 in FIGS. 5, 6 and 8. But the material that is currently preferred for this element 8 is plywood, masonite, celotex, plastic or solid metal. Preferable it is nailable, and is plywood, to which plasterboard, wallpaper, paint, pine or plastic paneling, or other final interior-finishing material may be attached. Plywood adds some insulating value to the wall; and stiff, thick celotex adds more. When celotex board is used at the wall interior, the celotex preferably is plastered by troweling or spraying.

When the panel comprises a door frame (14) or window frame (15) the can-supporting elements 3 and 8 (or 3 and 24) are nailed or otherwise fastened to opposite edges of the wall-opening framework; and these can-supporting elements are cut out (or else joined in separate pieces) to provide the wall opening. These frames may be made of any of the above-named materials of the bars 10, 11 and 12; and the frames and bars have a width in the neighborhood of the wall-exterior-to-interior width of the plurality of insulating layers of cans. The door-frame panel has a strip or bar, 16, which is fastened by nails, glue or the like to bottoms of the panel-side bars 12 and of the door frame 14. This strip may be of wood, strong plastic, or metal (for example, of roof-valley metal sheet or of metal lath). It has a width in the neighborhood of that of the members 12, 14 and 15. Preferably, a door or carpet sill, 18, is fixed to the upper surface of the strip 16. Optionally, the elements 16 and 18 may be integral—for example of molded strong plastic or shaped wood.

Preferably, the width of the can-backing elements 3 and 8 (or of 3 and 24) is equal to one of the dimensions of a standard commercially sold sheet of plywood, masonite, metal lath, or the like—for example, four, six or eight feet. When the cans do not snugly fill the space between opposite can-supporting bars, shims (20) of wood, plastic or metal may be juxtaposed to the bars to compactly fit the cans in place. But in the staggered-row forms of FIG. 9, such shims are not necessary for stable arrangement of the cans. In either event: in view of the stiffness of the elements 3, 8 and 12, and the staggering of the can-layers as in FIG. 9 or use of shims, the layers of cans on a standard-sized sheet are firmly and stably housed until the panels are joined in the wall; and there they are further stabilized by the mortar 4, or stucco 6 (and optionally also by interior wall-finishing materials).

FIGS. 4 to 7 illustrate another way of stably and snugly holding the can layers in place between can-holding elements 24 and 32 (or 3 and 8), and between the top and bottom elements 22 and 23 which in this inventive form are not like the bars 10 and 11 of FIG. 2, but comprise bar-like portions of concrete, optionally on metal lath. These concrete end elements have sufficient width to fill out the desired height (or else width) of the wall part.

This panel, as exampled in FIG. 4, may be made in accordance with the following method steps;

(1) Two side bars 12 (or 12') are placed in a rack that holds them in proper parallel position and proper space apart and a piece of metal lath is nailed or otherwise fastened to upper edges of the bars, with an end portion of the network projecting beyond each of the bars.

(2) The rack is removed and the projecting end portions of the metal lath are bent downward, so that the mesh becomes U-shaped. Optionally, this step may be performed before step (1)—in a powered bender or by hand.

(3) The combined bars and network are placed in a mold with hinged sides, with the mesh portion 24 flat at the bottom of the mold and the mesh portions 25 at opposite sides of the mold, with narrow spaces between these sides and the portions 25.

(4) A layer of the cans, having different lengths, is placed in the mold on the mesh portion 24. These cans are arranged in rows; and each row of each adjacent pair of the rows has a shorter can 26 (for instance a twelve-ounce used beer or soft-drink can) at one end of the said row which is alongside a longer can 27 of the other row of the said pair (for example, a 14 ounce or 16-ounce used beer can); and at the opposite end of the row from the short-can end there is a longer can 27 which is alongside a shorter can of the other row of the said pair. As illustrated in FIG. 7, as well as in FIGS. 2 and 3, all the intermediate cans between the end cans of the rows are longer cans. But other arrangements of the staggered cans may be made. For instance, all or part of the cans between the staggered end cans may be short cans. The criterion of this aspect of the invention is to have all or nearly all of the joints between cans of each pair of the rows staggered with respect to each other. Also in the form illustrated in FIG. 7, and also in FIG. 2, the different sizes of the cans are so arranged that all the rows are of equal length. But such is not always necessary. When the concrete (mortar) 28 is poured into the mold at one end of the cans, tying together ends of the cans and stabilizing the can rows in the panel, narrow spaces between some of the end cans and the adjacent mold wall are of advantage in holding the cans together by tongues of the concrete going into the narrow spaces and around can-end rims.

Method step (5): A second layer of the different-length cans is laid on top of the first can-layer. The can-rows of this upper layer may be arranged either as in FIG. 6 or FIG. 9. As illustrated in FIG. 4 (and also in FIG. 3), the joints between cans of each row of this second layer are staggered with respect to the can-joints of an adjacent can-row and also are staggered with respect to the can-joints of the lower layer of cans.

(6) An optional, but preferred, method step: a third layer of different-length cans is laid on top of the second can-layer, with the rows arranged as in FIG. 6 or FIG. 9. In this third layer also, the can-joints of each row are staggered with respect to each other and also with respect to the can joints of the second layer of cans.

(7) An optional step: a fourth layer of different-length cans is laid on top of the third can-layer, with the rows so arranged that their can-joints are staggered with respect to each other in the layer, and also with respect to those of the lower, third layer.

(8) A flat sheet of mesh, 32, preferably of metal lath, is laid in the mold on the top layer of cans. As indicated in FIG. 4, this network 32 has edges that slightly overlap the top edges of the side portions 25 of mesh.

(9) Mortar, (indicated at 28 and 34) is poured into the narrow spaces provided between the portions 25 and mold walls in method step (3). This motor penetrates the mesh of 25 and firmly ties together contiguous edges of the portons 25 and the upper sheet 32 of mesh. Thus the can rows are stably held in the panels.

(10) The completed panel is taken from the mold.

Step (3) of the above method may be varied by making one of the side portions 25 a separate piece of mesh; or by eliminating one of the portions 25, or by eliminating both of these portions so that the portion 24 then is a flat, substantially planar piece. When one of the elements 25 is eliminated, and one of the narrow spaces of step (3) is thus empty, the adjacent edges of the sheet 32 are slightly depressed into the top of that space, so that these edges are caught and firmly held by the mortar 28. When both of the elements 25 are eliminated both of the opposite edges at the narrow spaces are slightly depressed into the spaces.

FIG. 7 shows a modification of the invention form of FIG. 4, in which the upper portion 25 of the mesh and the lower mortar layer 34 are eliminated. Here, panels are supported on a concrete or other foundation 35, and the mesh 25' is fixed to the foundation by a layer of mortar (or adhesive) 36, troweled on 35.

FIGS. 10 and 11 show a modification of the invention comprising a wall of scantlings (studs, rafters or joists) and joined panels, each of the panels having a plurality of insulating can layers. In this form the panels are made in an upright mold; and matrix material 2 of the above-described type is poured downward into cavities between cans and into contact with the can-backing sheet 38 (similar to 8 or 24), but is excluded from contact with the side flanges 39 of this can-supporting sheet by removable mold-filler bars of the type shown at 18 in FIG. 15 of this inventor's patent application Ser. No. 772,218, referred to above. Before this matrix material is poured, a piece of metal lath or other strong, rather stiff mesh, 40, is placed alongside the upright wall of the mold which is opposite to the can-supporting element 38 and the upright mold wall that backs and supports it. The matrix material binds this mesh 40 to adjacent, staggered cans, stabilizing the panel.

Assembly of these panels of FIGS. 10 and 11 in the wall is accomplished by the following method: (1) a concrete foundation slab 42 (or other supporting means for the scantlings) is formed; (2) a wall-base plate, 44, of lumber or masonite, is fastened to the foundation; (3) the scantlings 46 are nailed or otherwise fastened to the base element 44 and to the wall plate 48; (4) each panel is positioned between two of the scantlings 46 and between the plates 44 and 48, with each of the flanges 39 fitting against the nailed or otherwise fastened to approximately one-half of the adjacent edge of each of the scantlings 46; (5) the outer wall-finishing material is applied. This may be either: siding or the bricks or blocks 5 and the insulating, porous-aggregate mortar 4 that preferably is dropped between the masonry units (or siding) and the mesh 40; or a first coat of stucco, 6, comprising porous, thermally insulating aggregate (such as cinders, crushed baked clay or shale, or vermiculite) and either a second finishing coat of stucco or wall-high outer wall panels, plywood, masonite, metal or plastic.

FIG. 12 shows used cans of the common coffee-containing or nut-containing type, which optionally may be used as the cans of this invention. As there illustrated, each of these cans has had one end plate removed; and the resulting opening is closed by the common plastic cap 50 which comes with the cans. These cans preferably are filled with easily poured insulation, 9 (preferably inexpensive and light in weight, such as preservativetreated bark particles, cinders, vermiculite, rice or other seed hulls, or ashes), and then they are closed by clamping the lids 50 on the rims of the can openings. The can-end plates 50 and 52 optionally may be glued or adhesive-taped together; but in view of the can-supporting elements 11 and 10 (or 25 and 28), as well as the bars 12 or the like, such fastening means currently is not preferred.

The constructon panel of the invention, without attachment flanges, as indicated in FIG. 4 may be assembled in any kind of wall—for example in an inside partition without masonry backing, or inside an outer wall part facing or insulatively "veneering" the outer surfaces of a concrete-block, brick or stud-and-sheathing wall-by attachment to other construction members and to floor or roof-supporting elements with epoxy putty, other strong adhesive or mortar.

Within the spirit of the invention various changes may be made. For examples: the panels having a plurality of can-layers may be made elongated and narrow (for instance, 8″×8″ in cross section), and then may be horizontally laid in an eight-inch wall, with mortar between adjacent horizontal panel faces; the cans of FIG. 9 may be more loosely arranged than they are shown in the drawing, thus eliminating any need of the shims 20; the can-rows of FIG. 11 may be staggered as in FIG. 9; the cans optionally may be new instead of used, or new or used cans of the paint-containing type instead of the types illustrated; and optionally each of the plurality of layers of cans may be heterogenously dumped into a mold in the manner indicated in FIGS. 10, 11 and 13 of application Ser No. 772,218 (U.S. Pat. No. 4,068,429), but more closely assembled than there shown, and the superposed can layers in the mold then are topped by matrix material of the above-described type. Also optionally, but not preferably at present, the axes of the cans of one or more of the insulating can-layers (of the layer that contacts the can-supporting sheet, or instead of both of two can-layers) may be substantially perpendicular to the inner and outer wall surfaces.

In the claims, unless otherwise qualified: "can" signifies a hollow container, open or sealed, of metal, plastic, glass or other material; "wall" means an upright wall or a roof, ceiling or floor; "stucco" means cement (mortar cement, portland, epoxy or other cement) mixed with fine aggregate, for example, sand, cinders, vermiculite, or the like; and "bar" means a long piece of wood, masonite, metal sheet or extrusion, metal lath or other panel-reinforcing material.

I claim:

1. A wall, including a base element, a plurality of can-comprising panels on said base element, each adjacent pair of the panels having panel edges that are juxtaposed to each other, means holding said edges in assembled relation, and wall-finishing material on one side of said panels; each of a plurality of said panels including:

a can-supporting element on the side of said panel opposite from said wall-finishing material;

at least one panel-reinforcing bar, connected to said can-supporting element;

a plurality of layers of cans on said can-supporting element, some of said cans being juxtaposed to said bar, the said cans of each of said layers being in contact with cans of at least one other of said layers; and means, including said bar and said panel-reinforcing network, for holding said cans in assembled relation;

the said wall including: scantlings having some of their ends fixed to ends of said bar; a plate fixed to ends of said scantlings opposite to said ends that are fixed to the bar; flanges on said can-supporting elements; and means connecting said flanges to said scantlings.

2. A wall as set forth in claim 1 in which: said wall is upright; said scantlings are upright wall-framing studs; and said plate is an upper wall plate.

3. A wall as set forth in claim 2, in which each of the said panels includes three of said attachment flanges, one of these three flanges being connected to said wall plate, and the other two of said three flanges being connected to said studs.

4. A wall as set forth in claim 1 in which said wall-finishing material comprises stucco.

5. A wall, including a base element, a plurality of can-comprising panels on said base element, each adjacent pair of the panels having panel edges that are juxtaposed to each other, means holding said edges in assembled relation, and wall-finishing material on one side of said panels; each of a plurality of said panels including:

a can-supporting element on the side of said panel opposite from said wall-finishing material;

at least one panel-reinforcing bar, connected to said can-supporting element;

a plurality of layers of cans on said can-supporting element, some of said cans being juxtaposed to said bar, the said cans of each of said layers being in contact with cans of at least one other of said layers;, and means, including said bar, for holding said cans in assembled relation;

at least one of the said panels including a door frame, defining a doorway, the said door frame comprising: side bars; an upper bar on said side bars, extending over said doorway; and a carpet sill, fixed to said side bars, extending across the bottom of said doorway.

6. A wall as set forth in claim 5, in which: said reinforcement network includes flanges on said door frame; and said penel further includes means fastening said flanges to said door frame.

7. A wall, including a base element, a plurality of can-comprising panels on said base element, each adjacent pair of the panels having panel edges that are juxtaposed to each other, means holding said edges in assembled relation, and wall-finishing material on one side of said panels; each of a plurality of said panels including:

a can-supporting element on the side of said panel opposite from said wall-finishing material;

at least one panel-reinforcing bar, connected to said can-supporting element;

a plurality of layers of cans on said can-supporting element, some of said cans being juxtaposed to said bar, the said cans of each of said layers being in contact with cans of at least one other of said layers; and means, including said bar, for holding said cans in assembled relation;

at least one of the said panels including: a window frame; network having attachment elements on said window frame; and means fastening said attachment elements to said frame.

8. A wall as set forth in claim 7, in which: each of said panels includes at least one other panel-reinforcing bar and includes panel-reinforcing network on said cans; the said bars have a width in the neighborhood of the thickness of said plurality of layers of cans; the said network has attachment flanges extending over portions of said bars; and the panel includes means fastening said flanges to said bars.

9. A wall, including a base element, a plurality of can-comprising panels on said base element, each adjacent pair of the panels having panel edges that are juxtaposed to each other, means holding said edges in assembled relation, and wall-finishing material on one side of said panels; each of a plurality of said panels including:

a can-supporting element on the side of said panel opposite from said wall-finishing material;

at least two panel-reinforcing bars, connected to said can-supporting element;

a plurality of layers of cans on said can-supporting element, some of said cans being juxtaposed to said bars, the said cans of each of said layers of cans being in contact with cans of at least one other of said layers;

panel-reinforcing network on said cans and means, including said bars and network, for holding said cans in assembled relation;

the said bars having a width in the neighborhood of the thickness of said plurality of layers of cans; the said network having attachment flanges extending over portions of said bars; and the said panel including means fastening said flanges to said bars.

10. A transportable wall part, comprising a wall panel, including:

a substantially planar can-supporting element;

four panel-reinforcing bars, connected to said can-supporting element, having edges on edge portions of said element;

a can-layer comprising a plurality of thermally insulating cans, on said can-supporting element, between said bars;

at least one other insulating layer of cans on said first can-layer;

panel-reinforcing network on said cans and means holding said network in place on the cans;

flanges that are integral with said network, jutting beyond said layers of cans and fixed to said bars; and means fastening each flange to its associated bar.

11. A wall as set forth in claim 10, the said bars comprising a pair of scantlings, and a cross bar fixed to end portions of said scantlings.

12. A wall as set forth in claim 10, in which the said cans in each of said layers are arranged in a plurality of rows of cans, the cans of each of said rows being end-joined in the row.

13. A wall as set forth in claim 12, in which the junctions between the end-joined cans of each row are staggered with respect to the junctions between can-ends of an adjacent row.

14. A wall as set forth in claim 12, in which the junctions between end-joined cans of each of said layers are staggered with respect to junctions between end-joined cans of an adjacent layer.

15. A wall as set forth in claim 10, including at least three of said layers of cans.

16. A wall as set forth in claim 10, in which said wall-finishing material comprises masonry units and mortar.

17. A wall part, comprising a transportable, substantially rigid panel, including:

a substantially quadrangular, can-supporting element;

four panel-reinforcing bars, connected to edge portions of said element;

at least two layers of cylindrical, thermally insulating cans stacked on said can-supporting element and arranged within said bars;

panel-reinforcing network over said cans, having integral network flanges lying on edge portions of said bars;

means fastening each flange to its associated bar; and stucco on said network, portions of said stucco extending thru mesh of the network into position over said cans, stabilizing the assembly of cans.

18. A wall part as set forth in claim 17, further including apertured, flanged means connected to said network and to portions of at least one of said bars, comprising means for fastening said panel to another panel in a wall.

19. A wall part as set forth in claim 18, in which said apertured, flanged means is integral with said panel-reinforcing network.

20. A transportable wall part, comprising a wall panel, including:

a substantially planar, panel-strengthening, can-supporting element;

four panel-reinforcing bars, connected to said can-supporting element, having edges on edge portions of said element;

four layers of thermally insulating cans on said can-supporting element, arranged tier upon tier, within said bars, the said cans of each of said layers being in contact with cans of at least one other of said layers, the axes of cans of each of said layers being staggered with respect to the axes of cans of at least one other of said layers; and means, including said bars and a second substantially planar panel-strengthening element over said cans, for holding said cans in assembled relation, the said second panel-strengthening element including flanges lying on edges of said bars that are opposite to said first-named edges;

means for fastening said flanges to said second-named edges of the bars; and flanged means connected to said second panel-strengthening element and to portions of at least one of said bars, comprising means for fastening said panel to another panel in a wall.

21. A wall part as set forth in claim 20, in which said flanged means is integral with said second panel-strengthening element.

* * * * *